US005683862A

United States Patent [19]

Majumdar et al.

[11] Patent Number: 5,683,862

[45] Date of Patent: Nov. 4, 1997

[54] POLY(ETHYLENE OXIDE) AND ALKALI METAL SALT ANTISTATIC BACKING LAYER FOR PHOTOGRAPHIC PAPER COATED WITH POLYOLEFIN LAYER

[75] Inventors: Debasis Majumdar; Michael W. Orem, both of Rochester, N.Y.

[73] Assignee: Eastman Kodak Company, Rochester, N.Y.

[21] Appl. No.: 740,579

[22] Filed: Oct. 31, 1996

[51] Int. Cl.[6] ..... G03C 1/89

[52] U.S. Cl. ..... 430/530; 430/527

[58] Field of Search ..... 430/527, 528, 430/529, 530

[56] References Cited

U.S. PATENT DOCUMENTS

| | | | |
|---|---|---|---|
| 3,630,740 | 12/1971 | Joseph et al. | 430/530 |
| 4,047,958 | 9/1977 | Yoneyama et al. | 430/527 |
| 4,268,623 | 5/1981 | Sera et al. | 430/529 |
| 4,272,616 | 6/1981 | Kishimoto | 430/529 |
| 4,304,852 | 12/1981 | Sugimoto et al. | 430/527 |
| 4,396,708 | 8/1983 | Ogawa et al. | 430/527 |
| 4,542,095 | 9/1985 | Steklenski et al. | 430/527 |
| 4,957,947 | 9/1990 | Chen et al. | 430/530 |
| 5,244,728 | 9/1993 | Bowman et al. | 428/330 |
| 5,254,448 | 10/1993 | Yamada et al. | 430/527 |

*Primary Examiner*—Christopher G. Young
*Attorney, Agent, or Firm*—Carl F. Ruoff; Robert A. Gerlach

[57] ABSTRACT

Described herein is a photographic paper coated with a polyolefin resin layer on each surface, one of the free surfaces of one of the polyolefin layers bearing a print retaining antistatic layer with improved spliceability and track off characteristics. The antistatic layer includes a polymeric latex binder and a non-ionic surface active compound having poly(ethylene oxide) and an alkali metal salt wherein the non-ionic surface active compound is between 0.1 and 4 percent by dry weight of the antistatic layer.

7 Claims, 2 Drawing Sheets

POLY(ETHYLENE OXIDE) AND ALKALI METAL SALT ANTISTATIC BACKING LAYER FOR PHOTOGRAPHIC PAPER COATED WITH POLYOLEFIN LAYER

1. Field of the Invention

This invention relates to antistatic backing layers with print or backmark retaining qualities, spliceability, minimized track off characteristics and to coating compositions suitable for the preparation thereof. More particularly, this invention relates to polyolefin coated photographic paper supports having on one side thereof a coating of a layer capable of (i) receiving and retaining various types of marking including, printing ink and the like, (ii) being joined through heat splicing and (iii) being conveyed through roller/nip transport machines with minimal track off.

2. Background of the Invention

U.S. Pat. No. 5,244,728 discloses backing formulations containing aluminum modified colloidal silica and an antistatic agent in a binder polymer consisting of an addition product of alkyl methacrylate, alkali metal salt and vinyl benzene. Although such backing layers provide adequate antistatic protection and backmark retention characteristics, these lack sufficient mechanical integrity as manifested in poor spliceability and track off characteristics.

U.S. Pat. No. 4,542,095 discloses an antistatic composition which includes a binder and a non-ionic surface active polymer having polymerized alkylene oxide monomers and an alkali metal salt characterized in that the composition is heterogeneous and comprises on a dry basis at least 7 weight percent polymerized alkylene oxide monomers. This patent does not discuss the problems of receiving and retaining various types of marking including printing ink and the like. Moreover, this patent does not discuss the problems of joining photographic paper through heat splicing.

U.S. Pat. No. 4,272,616 also discloses an antistatic backing which comprises a non-ionic polyoxyethylene surface active agent and at least one of a thiocyanate, iodide, perchloride and periodate in at least one layer. Again, this patent does not describe the problems of receiving and retaining various types of ink or joining photographic paper through heat splicing.

Splicing photographic paper rolls is often carried out during printing operations and is expected to provide enough mechanical strength to resist peeling as the web goes through automatic photographic processing. Poor splice strength can cause a number of problems including jamming of automatic processing devices. Track off during conveyance can lead to undesirable build-up of materials on conveyance rollers and other surfaces often causing product defects. The present invention is intended to provide remedy for such drawbacks without jeopardizing the other required qualities.

SUMMARY OF THE INVENTION

The present invention is photographic paper including a paper sheet with a polyolefin resin layer on each surface of said paper sheet. A print retaining antistatic layer is superposed on one of the free surfaces of the polyolefin layers at a dry coverage of from 90 to 500 mg/m$^2$. The antistatic layer includes a polymeric latex binder and a non-ionic surface active compound having poly(ethylene oxide) and an alkali metal salt wherein the non-ionic surface active compound comprises between 0.1 and 4 percent by dry weight of the antistatic layer.

Figure 1:
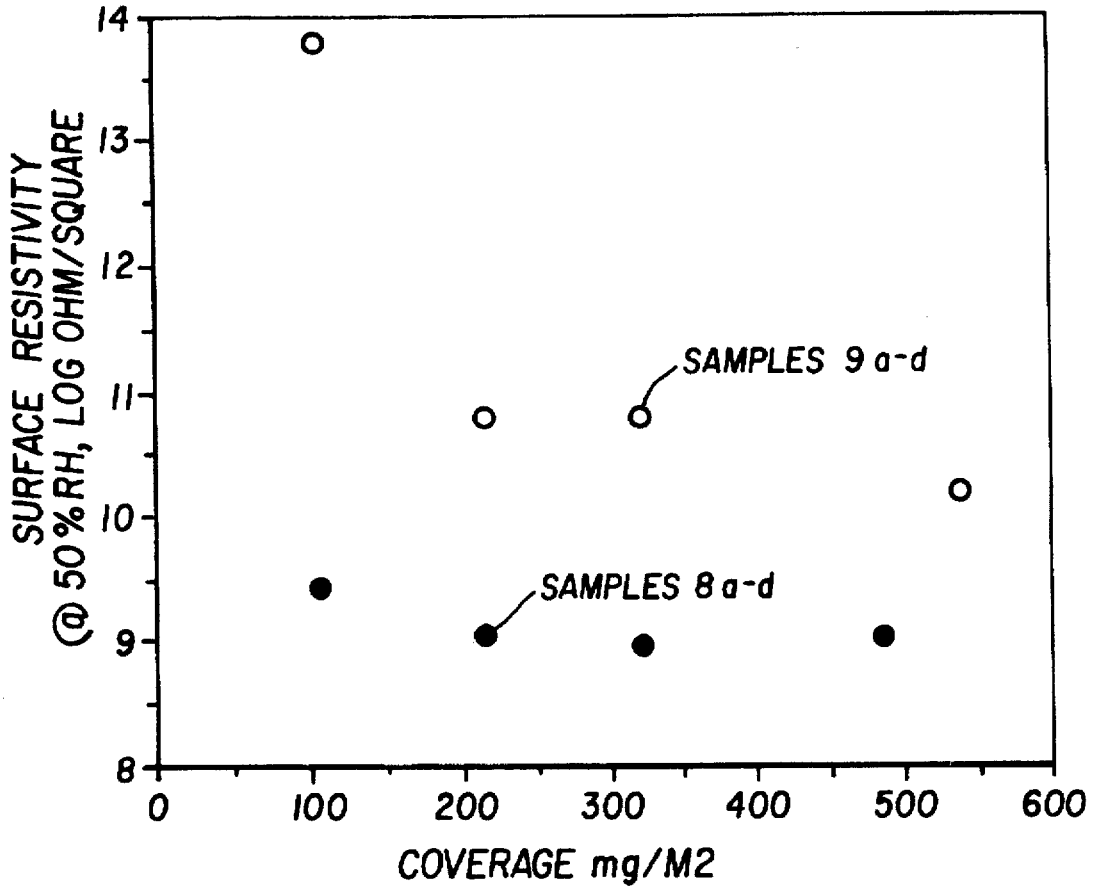
FIG. 1 is a comparison of the surface resistivities of samples using the coating of the present invention and prior art coatings.

For a better understanding of the present invention together with other objects, advantages and capabilities thereof, reference is made to the following description and appended claims in connection with the above-described drawings.

DETAILED DESCRIPTION OF THE PREFERRED EMBODIMENTS

This invention provides a photographic paper coated with a polyolefin resin layer on each surface, one of the free surfaces of one of the polyolefin layers bearing a print retaining antistatic layer with improved spliceability and track off characteristics. The antistatic composition comprises a binder and a non-ionic surface active compound having polymerized ethylene oxide and an alkali metal salt wherein the non-ionic surface active compound comprises between 0.1 and 4 percent by dry weight of the antistatic layer and the antistatic composition has a dry coverage of from 90 mg/m$^2$ to 500 mg/m$^2$.

While the invention herein finds particular use in the photofinishing industry to print barcodes or other indicia on the back of paper prints by using dot matrix printers for example, the invention described herein is useful and suitable for applying print or ink markings to any surface wherein the original surface does not possess the desired characteristics. The application with regard to photofinishing has a particularly stringent requirement because the backing layer must survive photographic processing through the automatic processing devices having the harshest conditions in order to be useful. In photofinishing applications, the coating compositions must satisfy the following requirements.

1. The ingredients must be compatible. This is a particularly stringent requirement when antistatic agents are employed in the coating composition so that the print retaining layer also possess antistatic properties. The binder polymer in the coating composition in the form of a latex can be easily destabilized causing agglomeration of the latex particles to occur.
2. The coatings must be alkali resistant up to a pH of 10 to survive the photographic processing solutions.
3. The coatings must be resistant to discoloration due to processing solutions and/or aging in the coating solution.
4. The coatings must be able to receive and retain ink or other marking materials through the photographic processing.
5. The coatings must not be photographically active and interfere with the light sensitive portions of the photographic paper.
6. The coatings must have resistivity less than 12 log ohms at 50% RH.
7. The backside coating must be spliceable to the frontside in commercially available splicing devices and maintain sufficient peel strength.
8. The coatings must be resistant to track off during conveyance by various roller/nip transport machines during manufacturing of the photographic paper and also in the development processor.
9. The coatings must be block resistant in the rolled form. That is, in preparation of printing paper for use in photographic applications, the paper in processing is rolled upon itself. It is necessary that the write retaining layer does not block together with the opposite surface of the paper support.
10. The wet coating formulations must have a stability of from6 to 12 months in order to be commercially acceptable.

The coatings and the coating compositions according to this invention satisfy these requirements by utilizing in combination a latex binder polymer and an antistatic agent comprising of alkali metal salt and a non-ionic surface active compound containing poly(ethylene oxide). Compounds having the following structures are excellent non-ionic surface active compounds:

R—O—A—Z HO—(D—B—D)—H wherein:

A comprises poly(ethylene oxide) having 10 to 30 repeating units of ethylene oxide; R is an alkyl or alkyl-aryl group containing between 12 and 18 carbon atoms; Z is hydrogen, methyl, or ethyl; B comprises poly(propylene oxide) having 15 to 60 repeating units of propylene oxide; D comprises poly(ethylene oxide) having 45 to 120 repeating units of ethylene oxide. Particularly preferred non-ionic surface active compounds are Pluronic surfactants sold by BASF Corporation which contain block oligomers of propylene oxide and ethylene oxide and Triton X-165 (t-octylphenoxy poly (ethylene oxide) (16 ) alcohol) available commercially from Union Carbide. The relative proportion of the surface active compound in the coating, on a dry basis, can be less than 4% by weight and preferably between 0.5% and 2%. Optionally, an aluminum modified colloidal silica can be incorporated in the coating composition. The relative proportion of the alumina modified silica in the coating, on a dry basis, can vary from 0% to 95%. Particularly preferred alumina modified colloidal silica is Ludox AM, sold by Du Pont Company. The latex binder can be the addition product of from about 30 to 78 mole percent of an alkyl methacrylate wherein the alkyl group has from 3 to 8 carbon atoms, from about 2 to about 10 mole percent of an alkali metal salt of an ethylenically unsaturated sulfonic acid and 20 to 65 mole percent of a vinyl benzene monomer where the polymer has a glass transition temperature from about 30° C. to about 65° C., as described in U.S. Pat. No. 5,244,728. Alternatively, other latex binders comprising styrene and/or acrylic copolymers, such as those disclosed in U.S. Pat. No. 5,466,536, can be chosen for this invention. The relative proportion of the latex binder can vary from 5% to 98% of the dry coating. The coating composition may be applied to the web with or without a defoaming agent, depending on the method of application. The defoaming agent when used must be compatible with the latex binder and must not cause destabilization or agglomeration. In some formulations where a cross-linkable latex is chosen as a binder, a suitable cross-linking agent may be incorporated to impart additional mechanical strength to the coating.

Optimum results for conductivity, print retention, splice strength and track off are obtained for dry coating compositions combining 35 to 90 weight percent alumina modified silica, 5 to 98 weight percent latex binder, 0.5 to 3 weight percent of alkali metal salt and 0.5 to 2 weight percent of poly(ethylene oxide) surfactant.

When a photographic paper containing a polyolefin layer on either side thereof is to be coated with a coating composition to impart ink retention to the surface, antistatic characteristics, spliceability, and pick off resistance, in accordance with this invention it is preferred that the polyolefin layer be corona discharge treated. The coating composition is coated at a coverage of between 90 mg/m$^2$and 500 mg/m$^2$. The composition is coated by any conventional method for coating aqueous solutions, such as direct or offset gravure and dried at temperatures between 32° and 85° C. While different photosensitive elements may require different coverages, the current invention can be applied to both color and black and white photosensitive papers with adjusted coverage values depending on the particular application. The layers prepared in accordance with this invention exhibit resistivities less than 12 log ohms/square at 50% relative humidity and preferably from about 9 to 11 log ohms/square.

The advantage of using a small amount of surfactant-LiNO3 combination can be manifold. Being surface active, the antistatic agent will be more concentrated at the surface of the antistatic layer and therefore provide necessary static protection at a weight percent and coverage much lower than required for bulk antistats, (such as one containing Carbowax 3350 supplied by Union Carbide with LiNO3 as disclosed in U.S. Pat. No. 5,244,728). This results in cost savings through reduced materials and energy spent in drying. The mechanical integrity of the coating improves, since the antistatic agent is at a low concentration in the bulk of the layer allowing better coalescence and film formation of the latex binder. Thus the splice strength and track off characteristics of the coating, which are related to its mechanical integrity, are better. These are illustrated through examples.

SAMPLE PREPARATION

Corona-discharge treated polyolefin coated photographic paper was used as the web on which aqueous coatings were applied through hopper coating and dried at 85° C. The coating coverage varied between 90 mg/m$^2$ and 500 mg/m$^2$ when dried. The samples were evaluated for surface resistivity, backmark retention, splice strength and track off.

TEST METHODS

Backmark Retention Test

A printed image was applied onto the coated papers prepared as above using a pre-process ribbon print. The paper was then subjected to a conventional developer for 30 seconds, washed with warm water for 5 seconds and rubbed for print retention evaluation. The following ratings are assigned, with numbers 1–3 indicating acceptable performance.

1=Outstanding, very little difference between processed and unprocessed appearance.

2=Excellent, slight degradation of appearance

3=Acceptable, medium degradation of appearance

4=Unacceptable, serious degradation of appearance

5=Unacceptable, total degradation.

Surface Resistivity Test

This test measures the surface resistivity of photographic papers. Samples are preconditioned at 50% RH 72° F. for at least 24 hours prior to testing. Surface resistivity is measured with a Keithly Model 616 digital electrometer using custom made electrodes.

Splice Strength Measurement

The backside of a strip of photographic paper containing the coating of interest is placed with 6–8 mm of overlap on the photographic element containing side of a similar strip of photographic paper and heated in a custom made set up for 4 seconds under 40 psi of pressure, replicating the conditions used by commercially available equipment used for heat splicing of photographic paper. The strength of the resultant splice is determined in an Instron machine as the force (measured in grams) necessary to peel the two strips apart, using a crosshead speed of 50 mm/min.

Track off Test

A loop is formed of a strip of photographic paper containing the coating of interest on its backside and is run for 30 minutes over a number of rollers and a stationary shoe in a custom made set up which simulates the conveyance of photographic web in a commercial printer. The rollers and the shoe are visually inspected for debris after the run and the number of specs accumulated at the shoe are counted as a measure of track off. The tests are done at 80% RH and 22° C., after preconditioning the sample at the same conditions for 12 hours, in order to maximize the generation of track off debris.

EXAMPLE 1

Sample 1 was coated as per the current invention using a surfactant-LiNO3 antistatic agent with Pluronic F88 supplied by BASF Corporation as the surfactant and sample 2 was coated similarly to the disclosure in Table II (column 5) of U.S. Pat. No. 5,244,728, using a Carbowax 3350-LiNO3 antistatic agent. The latex used in both samples is a styrene-co-butylmethacrylate-co-sodium 2-sulfoethylmethacrylate in the ratio of 30/60/10 as described in Table I (column 4) of U.S. Pat. No. 5,244,728. The dry coverage and the percentages of various components in these two aqueous coatings on a dry basis are listed in Table 1 and the corresponding test results are listed in Table 2. It is clear that the coating as per current invention (sample 1) provides superior mechanical properties as measured by splice strength and track off characteristics.

TABLE 1

| Sample | Ludox AM dry % | Latex dry % | LiNO3 dry % | Pluronic F88 dry % | Carbowax 3350 dry % | Coverage mg/ft2 |
|---|---|---|---|---|---|---|
| 1 | 49.3 | 49.3 | 0.5 | 0.9 | | 45 |
| 2 | 41.1 | 51.2 | 3.1 | | 4.6 | 45 |

TABLE 2

| Sample | Backmark retention | Surface resistivity at 50% RH, log ohm/□ | Splice strength Peel force, grams | Track off |
|---|---|---|---|---|
| 1 | 2 | 10 | 362 | Clean |
| 2 | 1 | 10 | 29 | 10 dark specs |

EXAMPLE 2

Samples 3 and 4 were coated using a commercial latex containing styrene acrylic copolymer, supplied by BF Goodrich as Carboset GA 1339. Sample 3 contained a surfactant-LiNO3 antistatic agent as discussed in the present invention, with Pluronic F88 supplied by BASF Corporation as the surfactant, and sample 4 contained a Carbowax 3350-LiNO3 antistatic agent as discussed in Table II (column 5) of U.S. Pat. No. 5,244,728. Sample 5 was coated using a composition similar to sample 3 but with additional cross-linking agent which was chosen to be a zirconium ammonium carbonate, supplied by Magnesium Elektron Limited as Bacote 20. The dry coverage and the percentages of various components in these three aqueous coatings on a dry basis are listed in Table 3 and the corresponding test results are listed in Table 4. It is clear that the coatings as per current invention containing a surfactant-LiNO3 antistatic agent (samples 3 and 5) provide superior splice strength, with and without the use of a cross-linking agent.

TABLE 3

| Sample | Ludox AM dry % | Latex dry % | Crosslinker dry % | LiNO3 dry % | Pluronic F88 dry % | Carbowax 3350 dry % | Coverage mg/ft2 |
|---|---|---|---|---|---|---|---|
| 3 | 76.7 | 19.1 | | 2.5 | 1.7 | | 30 |
| 4 | 73.8 | 18.5 | | 4.6 | | 3.1 | 30 |
| 5 | 76.7 | 19.1 | 0.05 | 2.5 | 1.7 | | 30 |

TABLE 4

| Sample | Backmark retention | Surface resistivity at 50% RH, log ohm/□ | Splice strength Peel force, grams |
|---|---|---|---|
| 3 | 3 | 9.5 | 324 |
| 4 | 2 | 9.5 | 138 |
| 5 | 3 | 9.5 | 340 |

EXAMPLE 3

Samples 6 and 7 were coated using a commercial latex containing acrylic copolymer supplied by BF Goodrich as Hycar PC-46. Sample 6 contained a surfactant-LiNO3 antistatic agent as discussed in the present invention, with Triton X-165 supplied by Union Carbide as the surfactant, and sample 7 contained a Carbowax 3350-LiNO3 antistatic agent as discussed in Table II (column 5) of U.S. Pat. No. 5,244,728. None of these two coating contained any inorganic filler, such as Ludox. The dry coverage and the percentages of various components in these two aqueous coatings on a dry basis are listed in Table 5 and the corresponding test results are listed in Table 6. It is clear, that other characteristics being equivalent, the coating prepared as per current invention containing a surfactant-LiNO3 antistat (sample 6) has superior splice strength.

TABLE 5

| Sample | Latex dry % | LiNO3 dry % | Triton X-165 dry % | Carbowax 3350 dry % | Coverage mg/ft2 |
|---|---|---|---|---|---|
| 6 | 96.0 | 2.4 | 1.6 | | 45 |
| 7 | 92.3 | 3.1 | | 4.6 | 45 |

TABLE 6

| Sample | Backmark retention | Surface resistivity at 50% RH, log ohm/□ | Splice strength Peel force, grams | Track off |
|---|---|---|---|---|
| 6 | 3 | 9 | 333 | clean |
| 7 | 3 | 9 | 20 | clean |

EXAMPLE 4

Figure 2:
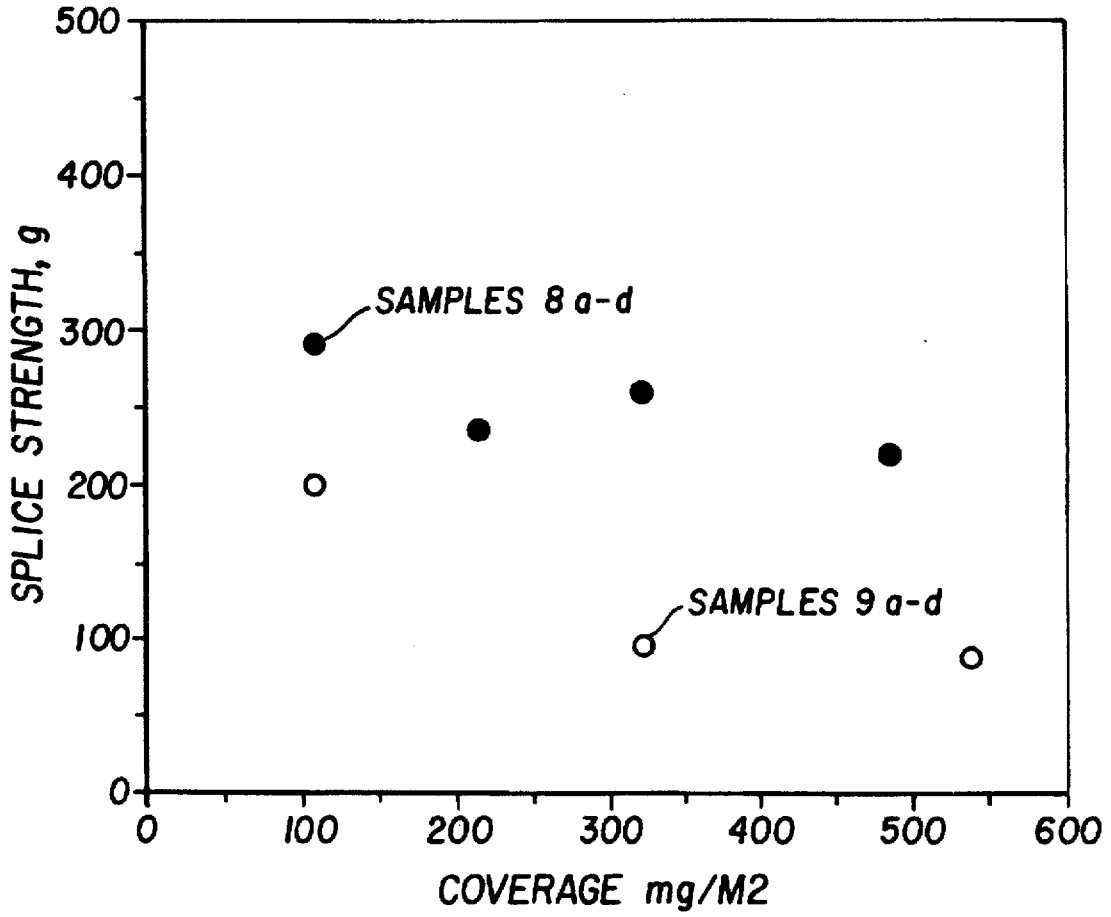
FIG. 2 is a comparison of the spliced strength between samples prepared with coatings of the present invention and prior art coatings.

Samples 8 a–d were coated as per the current invention using a surfactant-LiNO3 antistat with Pluronic F88 supplied by BASF Corporation as the surfactant and samples 9 a–d were coated containing a Carbowax 3350-LiNO3 antistatic agent antistatic agent as discussed in Table II (column 5) of U.S. Pat. No. 5,244,728. The latex used in all the samples of this example is the same latex used in Example 1 of the current invention which, as mentioned earlier, is a styrene-co-butylmethacrylate-co-sodium 2-sulfoethylmethacrylate in the ratio of 50/45/5 as described in Table I (column 4) of U.S. Pat. No. 5,244,728. The dry coverage and the percentages of various components in these two sets of aqueous coatings on a dry basis are listed in Table 7. As shown in FIG. 1, the surface resistivity of samples 9 a–d shows a steep increase at coverage below 200 $mg/m^2$ whereas the surface resistivity of samples 8 a–d, prepared as per the current invention containing a surfactant-LiNO3 antistat, does not show such a strong dependence on coverage and, in general, is of lower magnitude. Based on this plot, one can conclude that the coatings prepared as per current invention can provide antistatic protection at a coverage as low as 100 $mg/m^2$. As shown in FIG. 2, the splice strength of samples 8 a–d, prepared as per the current invention containing a surfactant-LiNO3 antistat, is also higher than that of samples 9 a–d, containing Carbowax-LiNO3 antistat. These two plots indicate the superiority of the coatings prepared as per the current invention, in terms of surface resistivity and splice strength.

TABLE 7

| Sample | Ludox AM dry % | Latex dry % | LiNO3 dry % | Pluronic F88 dry % | Carbowax 3350 dry % | Coverage mg/ft2 |
|---|---|---|---|---|---|---|
| 8a | 76.7 | 19.1 | 2.5 | 1.7 | | 45 |
| 8b | " | " | " | " | | 30 |
| 8c | " | " | " | " | | 20 |
| 8d | " | " | " | " | | 10 |
| 9a | 74 | 18.5 | 3.0 | | 4.5 | 50 |
| 9b | " | " | " | | " | 30 |
| 9c | " | " | " | | " | 20 |
| 9d | " | " | " | | " | 10 |

In general the above examples illustrate the advantage of using a small amount of surfactant—$LiNO_3$ combination as the antistatic agent, as disclosed in this patent. The benefits mainly stem from the surface activity of the surfactants chosen, over other poly(ethylene oxide) materials such as Carbowax 3350 supplied by Union Carbide as disclosed in U.S. Pat. No. 5,244,728. Table 8 documents the surface tension data for solutions of two of the surfactants disclosed in this patent, namely, Pluronic F88 and Triton X-165, and Carbowax 3350 from Union Carbide disclosed in U.S. Pat. No. 5,244,728. It is clear that both Pluronic F88 and Triton X-165 have lower surface tension and, thus, higher surface activity, than Carbowax 3350. Being surface active, the antistatic agent disclosed in this patent is expected to be more concentrated at the surface of the antistatic layer and therefore provides necessary static protection at a weight percent and coverage much lower than required for bulk antistats, (such as one containing Carbowax 3350 supplied by Union Carbide with $LiNO_3$ as disclosed in U.S. Pat. No. 5,244,728) as evident in the previous examples. This results in cost savings through reduced materials and energy spent in drying. The mechanical integrity of the coating also improves, as the antistatic agent is at a low concentration in the bulk of the layer allowing better coalescence and film formation of the latex binder. Thus the splice strength and track off characteristics of the coating, which are related to its mechanical integrity, also improve considerably.

| Sample | Aqueous Concentration % | Surface Tension Dynes/cm |
|---|---|---|
| Pluronic F88 | 0.025 (wet coating concentration of sample 1) | 51.0 |
| Pluronic F88 | 0.138 | 45.5 |
| Triton X-165 | 0.05 (wet coating concentration of sample 6) | 36.0 |
| Triton X-165 | 0.138 | 36.5 |
| Carbowax 3350 | 0.138 (wet coating concentration of sample 2) | 62.7 |

The term non-ionic surface active compounds includes non-ionic compounds that have a surface tension of less than 55 dynes/cm in aqueous solutions having concentrations of 0.025 to 0.138 weight percent of the compounds using a Wilhelmy plate technique at 25° C. If the aqueous solution of the compound has a higher surface tension, the compound is not considered surface active. Carbowax 3350 is not considered a surface active compound.

While there has been shown and described what are presently considered to be the preferred embodiments of the invention, various modifications and alterations will be obvious to those skilled in the art. All such modifications and alterations are intended to fall within the scope of the appended claims.

What is claimed is:

1. A photographic paper comprising a paper sheet with a polyolefin resin layer on each surface of said paper sheet;

a print retaining antistatic layer having a dry coverage of from 90 $mg/m^2$ to 500 $mg/m^2$ on one of the free surfaces of the polyolefin layers comprising a polymeric latex binder and a non-ionic surface active compound having poly(ethylene oxide) and an alkali metal salt wherein the non-ionic surface active compound comprises between 0.1 and 4 percent by dry weight of the antistatic layer.

2. The photographic paper of claim 1, wherein said polymeric latex binder comprises the addition product of from 30 to 78 mole percent of an alkylmethacrylate wherein the alkyl group has from 3 to 8 carbon atoms, from 2 to about 10 mole percent of an alkali metal salt of an ethylenically unsaturated sulfonic acid and from 20 to 65 mole percent of a vinyl benzene monomer, said polymer binder having a Tg of from 30° C. to 60° C.

3. The photographic paper of claim 1, wherein said polymeric latex binder comprises styrene co-butylmethacrylate-co-sodium 2-sulfoethyl methacrylate.

4. The photographic paper of claim 1, wherein said print retaining antistatic layer further comprises aluminum modified colloidal silica.

5. The photographic paper of claim 4, wherein the print retaining static layer comprises on a dry weight basis 35 to 90% aluminum modified silica, 5 to 98% polymer latex binder, 0.5 to 3% alkali metal salt and 0.5 to 2 percent poly(ethylene oxide).

6. The photographic paper of claim 1, wherein said non-ionic surface active compound comprises:

R—O—A—Z HO—(D—B—D)—H wherein:

A comprises poly(ethylene oxide) having 10 to 30 repeating units of ethylene oxide; R comprises an alkyl or alkyl-aryl group containing between 12 and 18 carbon atoms; Z comprises hydrogen, methyl, or ethyl; B comprises poly(propylene oxide) having 15 to 60 repeating units of propylene oxide; and D comprises poly(ethylene oxide) having 45 to 120 repeating units of ethylene oxide.

7. The photographic paper of claim 1, wherein alkali metal salt comprises $LiNO_3$.

* * * * *